US006321468B1

(12) United States Patent
DeGrand et al.

(10) Patent No.: US 6,321,468 B1
(45) Date of Patent: Nov. 27, 2001

(54) FOOTWEAR OUTSOLE HAVING ARCUATE INNER-STRUCTURE

(75) Inventors: Peter J. DeGrand, Topeka, KS (US); Edward Chen, Nan Twen District (TW)

(73) Assignee: Payless ShoeSource, Inc., Topeka, KS (US)

( * ) Notice: Subject to any disclaimer, the term of this patent is extended or adjusted under 35 U.S.C. 154(b) by 0 days.

(21) Appl. No.: 09/113,780

(22) Filed: Jul. 10, 1998

(51) Int. Cl.[7] ..... A43B 13/22

(52) U.S. Cl. ..... 36/102; 36/103; 36/25 R; 36/59 C

(58) Field of Search ..... 36/102, 103, 25 R, 36/30 R, 32 R, 29, 3 B, 59 R, 59 C; 2/953, 960

(56) References Cited

U.S. PATENT DOCUMENTS

| | | | |
|---|---|---|---|
| 500,385 | | 6/1893 | Hall . |
| 2,150,057 | * | 3/1939 | Fisch . |
| 2,211,057 | | 8/1940 | Duckoff . |
| 4,041,618 | | 8/1977 | Famolare, Jr. . |
| 4,059,910 | | 11/1977 | Bryden et al. . |
| 4,241,524 | | 12/1980 | Sink . |
| 4,439,936 | | 4/1984 | Clarke et al. . |
| 4,538,366 | * | 9/1985 | Norton . |
| 4,658,514 | * | 4/1987 | Shin . |
| 4,777,738 | * | 10/1988 | Giese et al. . |
| 4,779,361 | | 10/1988 | Kinsaul . |
| 4,827,631 | | 5/1989 | Thornton . |
| 4,910,882 | * | 3/1990 | Goller . |
| 4,924,606 | | 5/1990 | Montgomery et al. . |
| 5,319,866 | | 6/1994 | Foley et al. . |
| 5,339,544 | | 8/1994 | Caberlotto . |
| 5,408,761 | | 4/1995 | Gazzano . |
| 5,448,839 | | 9/1995 | Blissett et al. . |
| 5,619,809 | | 4/1997 | Sessa . |
| 5,768,806 | * | 6/1998 | Parisotto . |
| 5,839,208 | * | 11/1998 | Huang . |

FOREIGN PATENT DOCUMENTS

| | | | |
|---|---|---|---|
| 407921 | * | 1/1925 | (DE) . |
| 495067 | * | 4/1929 | (DE) . |
| 909546 | * | 7/1949 | (DE) . |
| 510426 | * | 8/1939 | (GB) . |
| 2150010 | * | 6/1985 | (GB) . |

* cited by examiner

*Primary Examiner*—Ted Kavanaugh
(74) *Attorney, Agent, or Firm*—Lathrop & Gage L.C.

(57) ABSTRACT

An outsole having a body member with an inner-structure including a plurality of arcuately shaped ribs extending substantially from the medial to lateral sides thereof. The plurality of arcuately shaped ribs are spaced forwardly, rearwardly, and generally below the metatarsophalangeal joints of a wearer's foot inserted in footwear constructed from the outsole. The inner-structure includes a plurality of sidebars extending forwardly and rearwardly from each of the plurality of arcuately shaped ribs to promote arcuate flexure in front of, behind, and between each of the ribs. The body member includes a peripheral member spaced along the perimeter and connected to the ends of each of the plurality of arcuately shaped ribs, toe and heel support structures configured to reduce flexure in spaces defined between those structures and the peripheral member. The outsole also includes a tread member and a stabilizing member imposed between, and connected to each of, the body member and the tread member.

25 Claims, 3 Drawing Sheets

FOOTWEAR OUTSOLE HAVING ARCUATE INNER-STRUCTURE

BACKGROUND OF THE INVENTION

1. Field of the Invention

This invention relates generally to footwear and, more specifically, without limitation, to an outsole for footwear.

2. Description of the Related Art

Various man-made products are generally imposed between a user's feet and supporting surfaces situated therebeneath. Such man-made products should generally be designed to provide support and shock attenuation to provide protection for, including prevent structural injury to, the user's feet. In addition, some of such man-made products are also designed to provide improved appearance, convenience, endurance, etc. Unfortunately, such man-made products tend to be detrimental to the human musculoskeletal structures.

As disclosed in U.S. Pat. No. 4,272,899, issued Jun. 16, 1981 to Jeffrey S. Brooks, the disclosures and teachings of which are incorporated herein by reference, a contoured insole structure may be provided in shoes to reduce abnormal stress from the heel to the metatarsals by properly supporting and stabilizing the feet during development thereof. By so doing, the associated stresses placed upon the medial column of the foot is also reduced, distributing the body weight more evenly on the sole of the foot.

More specifically, when walking or running, the lateral (outside) portion of the human heel is generally the first part of the foot to strike the ground, with the foot then pivoting on the heel to bring the lateral part of the forefoot into a position whereat it bears against an underlying surface. At that point, the foot resides in a supinated (inclined upwardly from the lateral to the medial side of the foot). The foot then pronates until all of the metatarsal heads are in a substantially horizontal planar orientation relative to the underlying supporting surface (assuming the supporting surface is substantially horizontal) and the heel, ideally, is oriented perpendicularly to that underlying surface. The foot is then in a neutral position with the subtalar joint thereof, neither pronated nor supinated. The bone structural alignment should be firmly supported when the foot assumes such neutral position in order to prevent the ligaments, muscles and tendons of the foot from becoming over-stressed.

Various skeletal characteristics of the feet that are pertinent to proper foot support include the first, second, third, fourth and fifth metatarsal heads, indicated in phantom at M1 through M5 in FIG. 1; first, second, third, fourth and fifth metatarsal necks associated with the respective metatarsal heads M1–M5, indicated in phantom at N1 through N5; first, second, third, fourth and fifth proximal phalanges spaced distally from the respective metatarsal heads M1–M5, indicated in phantom at P1 through P5; and first, second, third, fourth and fifth metatarsal phalangeal joints spaced between the respective metatarsal heads M1–M5 and proximal phalanges P1–P5, indicated at J1 through J5 in FIG. 1. Further, various muscles and tendons characteristically interact to stabilize the foot during the sequence of progressive movements normally experienced in a walking or running gait in preparation for movement from the neutral position to a propulsive phase of the gait cycle, sometimes referred to as "toe-off" or "push-off".

Thus, the progressive phases of gait are heel strike, when the heel hits the ground; midstance, when stability of the arch is an essential necessity; and propulsive phase, as the heel lifts off the ground and the body weight shifts onto the ball of the foot. During the transition from the neutral position through toe-off, it is preferable that the second and third metatarsals be firmly supported, and that the first metatarsal head plantarflex (move downward) relative the second and third metatarsal heads. The toes also should generally be firmly supported during toe-off so that they remain straight, and thus stronger, promoting a "pillar effect" by the phalanges.

Flexion of the first metatarsal phalangeal joint (i.e., the great toe joint) is normally approximately fifteen degrees to the associated metatarsal in a dorsiflexed position when standing, and increases to between sixty-five and ninety degrees, depending on the available motion and the activity required by the joint just prior to lifting off the underlying supporting surface. Proper foot care requires that the relationship among the foot bones comprising the metatarsophalangeal joints be maintained during flexure of the foot during walking, running, etc. A study of the normal length pattern of metatarsal bones at the metatarsophalangeal joints, based on 279 radiographs and reported in *Clinical Foot Roentgenology*, by Gamble & Yale, Williams & Wilkins Publishers, Baltimore, 1966, disclosed that the relative spacing of those joints approximate an arcuate relationship that may be generally described as a parabolic curve, as suggested by the dashed line designated by "A" in FIG. 1.

In an ideal foot posture situation for minimal stress, the position in which the feet, as weight-bearing organs, would normally realize greatest efficiency (including an optimal ratio of supination and pronation) is one in which the subtalar joint is approximately forty-two degrees from the transverse plane, approximately sixteen degrees from the saggital plane, and approximately forty-eight degrees from the frontal plane, sometimes referred to as the neutral position hereinbefore mentioned. In the neutral position, the leg and calcaneus are perpendicular to the weight bearing surface, and the knee joint, ankle joint and forefoot, including the plane of the metatarsal heads, are substantially parallel to the subtalar joint and to the walking surface.

In view of the foregoing, it should be obvious that the user's feet should be placed in their individually most efficient position to function properly and to reduce excessive strain not only on the feet but also on the lower body structure supported by the feet, that certain parts of the feet are generally subjected to higher stresses during standing, running and walking, and that other parts of the feet require different degrees of support for maximum biomechanical efficiency, particularly since high impact forces to the foot are generally transferred to other skeletal structures, such as the shins, knees, and lower back region. Control of the user's foot must begin in the heel and progressively proceed to the more distally situated parts of the foot, including providing stability of the forefoot and proper flexure of the metatarsophalangeal joints, in order for the foot to function properly through the normal phases of gait.

As the thickness of the outsole of a shoe is increased, the inability of the shoe to allow appropriate arcuate flexure at the metatarsal joints of the wearer's foot confined to thick-soled footwear becomes more pronounced. For example, such thick-soled footwear may arise from platform-type outsoles utilized on selected footwear to enhance the wearer's apparent height, on a corrective shoe to compensate for the difference in length of the wearer's legs, etc.

Because of the inability of platform- or thick-soled shoes to allow such appropriate flexure, the normal functions of the wearer's foot—and the resulting increased stresses and strains on the wearer's musculo-skeletal structure—may also be substantially pronounced. In that event, proficiency of a wearer's foot may be greatly reduced in footwear utilizing platform- or thick-soled footwear.

Thus, what is needed is an outsole for footwear which, even when having a platform-type structure, provides appropriate flexure at the metatarsophalangeal joints, an appropriate amount of support and shock attenuation for different regions of the foot to thereby provide a proper environment that promotes a balanced foot position for healthy postural and skeletal structural support thus allowing the parts of the foot to function in a way which provides maximum efficiency, to prepare the body for stresses normally subjected thereto, and to protect those parts of the foot which are subjected to high impact forces.

SUMMARY OF THE INVENTION

In an outsole for footwear, there is provided a body member having a medial side, a lateral side, a toe end, and a heel end; the body member has an inner-structure including a plurality of arcuately shaped ribs having a substantially uniform fore-to-aft width and extending substantially from the medial side to the lateral side. The plurality of arcuately shaped ribs are generally uniformly spaced apart. The plurality of arcuately shaped ribs are configured such that at least one thereof is spaced forwardly from metatarsophalangeal joints of a wearer's foot inserted in footwear constructed with the body member, at least one thereof is spaced rearwardly from the metatarsophalangeal joints, and intermediate ones thereof are spaced generally below the metatarsophalangeal joints.

The inner-structure also includes a plurality of sidebars extending forwardly and rearwardly from each of the plurality of arcuately shaped ribs, wherein the outward extent thereof is approximately one-half of the spacing between respective adjacently spaced arcuately shaped ribs. The plurality of sidebars extending toward each other from adjacently spaced arcuately shaped ribs are laterally offset from each other.

The body member also includes a peripheral member spaced along the perimeter thereof wherein the peripheral member is connected to each of the plurality of arcuately shaped ribs; a toe support structure connected to the peripheral portion and configured to reduce flexure in a space defined by a foremost one of the arcuately shaped ribs and the peripheral portion, and a heel support structure connected to the peripheral portion and configured to reduce flexure in a space defined by a rearmost one of the arcuately shaped ribs and the peripheral portion.

The outsole also includes a tread member and a stabilizing member imposed between, and connected to each of, the body member and the tread member.

PRINCIPAL OBJECTS AND ADVANTAGES OF THE INVENTION

Principal objects and advantages of the present invention include: providing an outsole that promotes arcuate flexure of a wearer's metatarsophalangeal joints when confined to footwear constructed with such an outsole; providing such an outsole having arcuately shaped ribs extending substantially from medial to lateral sides thereof for promoting such flexure therebetween; providing such an outsole that utilizes sidebars extending forwardly and rearwardly from such ribs to provide support and flexure between such ribs; and generally providing such a device that is efficient in operation, reliable in performance, and is particularly well adapted for the proposed usage thereof.

Other objects and advantages of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
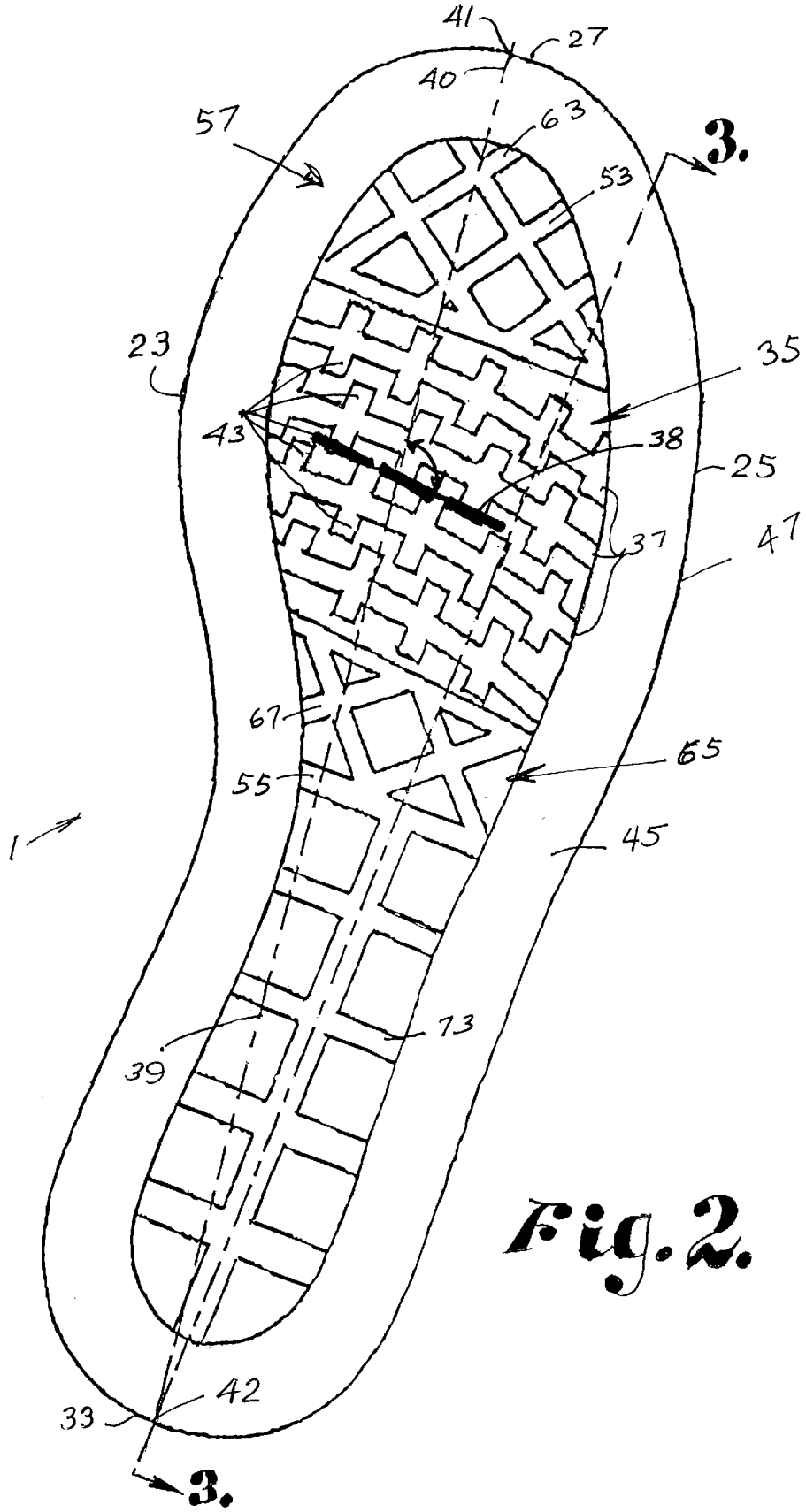
FIG. 2 is a top plan view of a footwear outsole having an arcuate inner-structure for a user's right foot, in accordance with the present invention.
Figure 3:
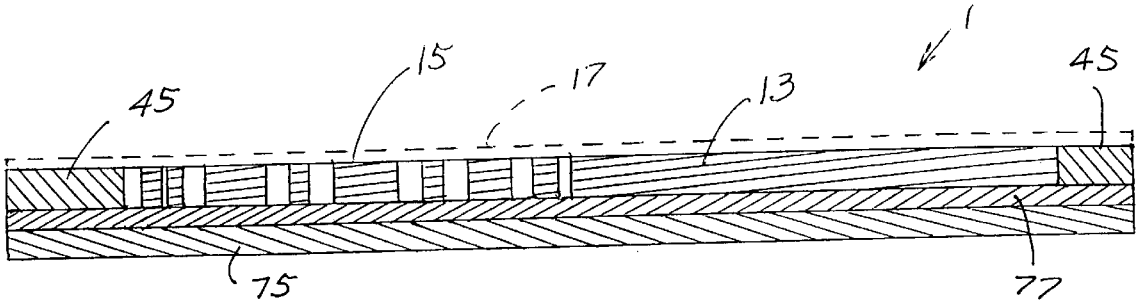
FIG. 3 is a cross-sectional view of the footwear outsole having an arcuate inner-structure, taken along line 3—3 of FIG. 2.
Figure 4:
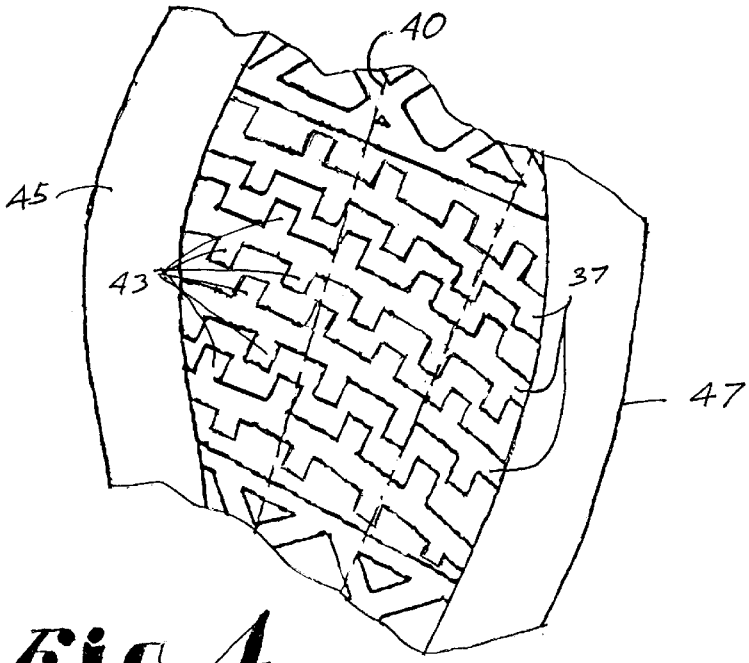
FIG. 4 is a fragmentary, top plan view of an alternative configuration of the footwear outsole having an arcuate inner-structure, in accordance with the present invention.

The reference numeral 1 generally refers to a footwear outsole having an arcuate inner-structure in accordance with the present invention, as shown in FIGS. 2 through 4. The outsole 1 comprises a body member 13 having a generally planar upper surface 15 for comfortable stable support for an insole and related structure of the footwear, symbolized by a phantom layer designated by the numeral 17 in FIG. 3, known to those having skill in the pertinent art. The outsole 1 generally has a medial side 23, a lateral side 25, a toe end 27, and a heel end 33.

The body member 13 has an inner-structure 35 having an arcuately shaped transverse member such as a plurality of ribs 37 extending continuously substantially from the medial side 23 to the lateral side 25 thereof in order to, among other things, prevent the outsole 1 from spreading laterally outwardly when the user's weight bears down on the outsole 1. Preferably, each of the ribs 37 has a substantially uniform fore-to-aft width, such as approximately 3 mm for example. For some applications, however, it is to be understood that the foreto-aft width of one or more of the ribs 37 may be non-uniform and, further, that the fore-to-aft widths of the ribs 37 may vary from rib 37 to rib 37.

Figure 1:
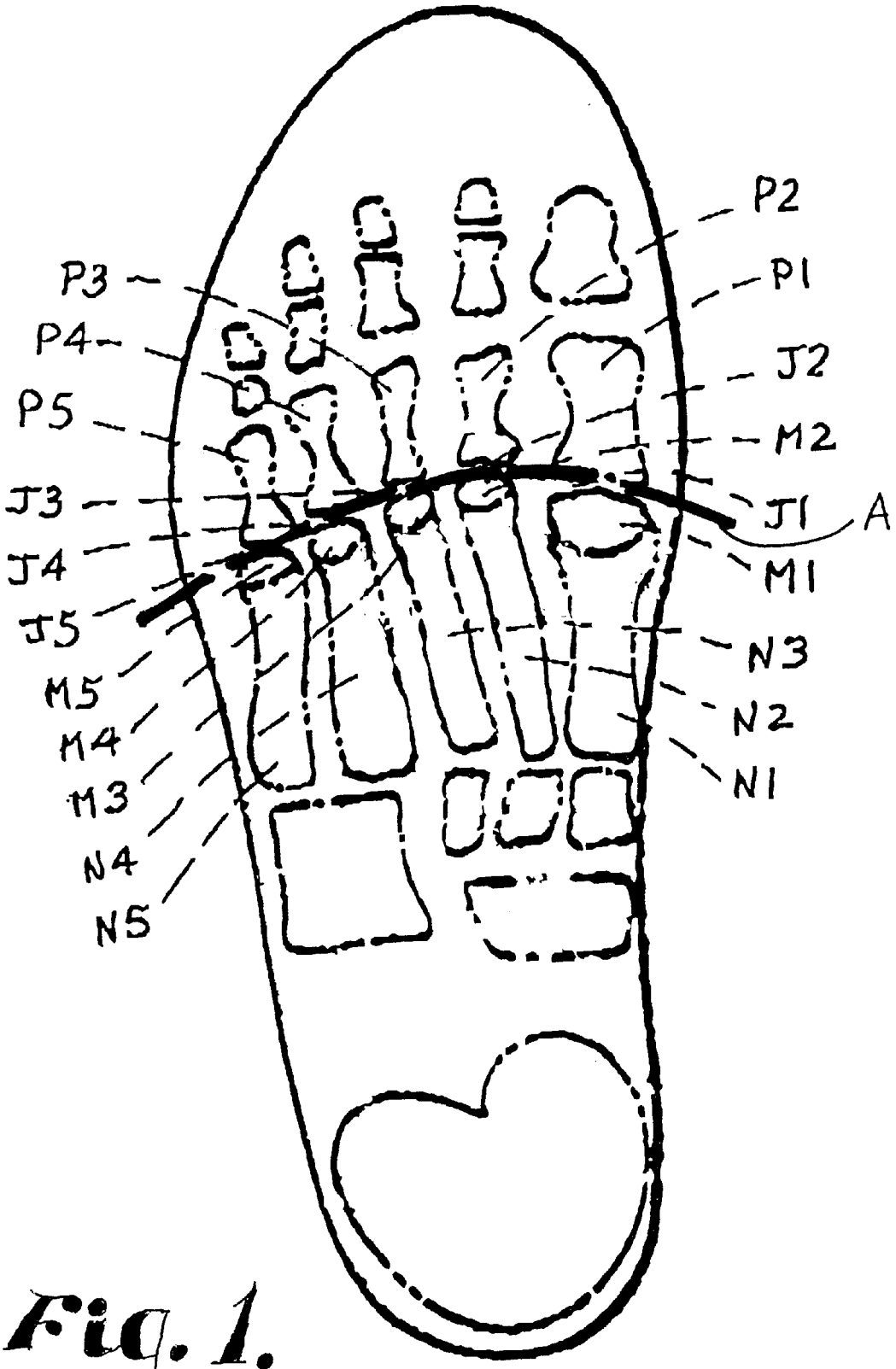
FIG. 1 is a schematic illustration, showing a top plan view of an insole of a left shoe and illustrating the approximate position of the metatarsal and related bone structure of a user's left foot in relation thereto.

The plurality of ribs 37 are configured in a forwardly convex arcuate shape, such as the approximately parabolic shape as shown in FIG. 1, as appropriate for the relative positioning of the wearer's metatarsophalangeal joint based on the wearer's age, gender, foot size, etc. In addition, the plurality of ribs 37 are generally substantially uniformly spaced apart and are configured, such as approximately 8 mm for example, such that one or more foremost ones of the ribs 37 are spaced forwardly from the metatarsophalangeal joints of a wearer's foot inserted in footwear constructed with the body member 13, one or more rearmost ones of the ribs 37 are spaced rearwardly from the metatarsophalangeal joints, and intermediate ones of the ribs 37 are spaced generally below, and thereby accommodate flexure of, the metatarsophalangeal joints. For a growing foot, the ribs 37 substantially underlying the metatarsophalangeal joints of the youth are generally spaced apart by the amount of foot growth that can be accommodated without replacing the footwear utilizing the outsole 1, such as one-half shoe size for example.

The inner-structure 35 also includes a plurality of sidebars 43, having a width of approximately 3 mm for example, extending approximately perpendicularly outwardly, both forwardly and rearwardly, from each of the plurality of arcuately shaped ribs 37. The sidebars 43 on each side of the arcuately shaped ribs 37 are appropriately spaced apart to provide desired support between the respective ribs 37, such as approximately 8 mm for example.

Preferably, the outermost extent of each of the plurality of sidebars 43 is approximately one-half of the spacing between respective adjacently spaced arcuately shaped ribs 37. In other words, each of the plurality of sidebars 43 preferably spans approximately one-half of the distance between the respective rib 37 to which each sidebar 43 is attached and the rib 37 toward which the respective sidebar 43 extends. It is to be understood that some sidebars 43 may extend outwardly from its respective rib 37 more or less than the outward extent of other ribs 37, and that selected ones of the sidebars 43 may extend more or less than half-way toward the adjacent rib 37. The plurality of sidebars 43 extending toward each other from adjacently spaced arcuately shaped ribs 37 are laterally offset from each other in order to promote flexure of the outsole 1 approximately in front of, behind, and midway between, each of the ribs 37.

The sidebars 43 extending forwardly from each of the ribs 37 may be aligned with the sidebars 43 extending rearwardly from respective ribs 37 to form crossbars as shown in FIG. 2. Alternatively, the sidebars 43 extending forwardly from each of the ribs 37 may be laterally offset from the sidebars 43 extending rearwardly from respective ribs 37, as shown in FIG. 3.

An example of a spatial relationship between the arcuate ribs 37 and the sidebars 43 can be described as follows. A plane, perpendicular to the body member 13 and defined by distal ends of adjacently spaced ones of two sidebars 43 extending forwardly an arcuately shaped rib 37 substantially underlying the wearer's metatarsophalangeal joints as shown and designated by the numeral 38 in FIG. 2, intersects another plane, designated by the numeral 39 in FIG. 2, which is also perpendicular to the body member 13 and defined by a line 40 through a foremost substantially symmetrical center 41 of the toe end 27 of the outsole 1 and through a rearmost substantially symmetrical center 42 of the heel end 33 of the outsole 1, at an obtuse angle, such as an angle of 100° for example.

The outsole 1 also includes a peripheral member 45 spaced along a perimeter 47 thereof wherein the peripheral member 45 is connected to each outer end of the plurality of arcuately shaped ribs 37. Further, the body member 13 includes a toe support structure 53 and a heel support structure 55, each of which is connected to the peripheral member 45. The toe support structure 53 includes a flexure reducing structure 57, such as a diagonal crisscross type structure 63 as shown in FIG. 2, configured to reduce flexure in a space defined by a foremost one of the arcuately shaped ribs 37 and the peripheral member 45. Similarly, the heel support structure 55 includes a flexure reducing structure 65 arcuately shaped ribs 37 and the peripheral member 45, all or a portion of which may also include the diagonal criss-cross type structure 67.

It is to be understood that the flexure reducing structures 57, 65 may have any other configuration or combination of configurations, including an egg crate-type structure 73, or other suitable arrangement. One of the purposes for the flexure reducing structures 57, 65 is to provide suitable support for the wearer's foot while preventing excessive lateral, forward, and rearward deflection of the respective spaces of the outsole 1 when subjected to the wearer's weight and while, at the same time, providing shock-absorbing characteristics for cushioning impacts directed at the wearer's foot during various walking, running, etc., activities.

The outsole 1 also includes a tread member 75 and a stabilizing member 77 imposed between, and connected to each of, the body member 13, the peripheral member 45, and the tread member 75. The stabilizing member 77 continuously spans the entire length and width of the outsole 1. Although the cross-section of the tread member 75 is shown as having solid structure in FIG. 3, it is to be understood that the tread member 75 may be configured to have almost any conceivably pattern as the continuous stabilizing member 77 prevents debris from entering any open spaces, of the body member 13 from the tread member 75. For some applications, it may be desirable to utilize a pattern in the tread member 75 which further enhances flexure of the metatarsophalangeal joints promoted by the body member 13 as herein described.

The body member 13 is generally integrally molded or otherwise formed or constructed from one or more pliable materials that provides the desired flexure, cushioning, light-weightness, physical characteristics, wearability, slip resistance, durability for long use, and relative inertness. For example, the body member 13 may be formed of any suitable material, such as DPU sometimes referred to as blown thermoplastic rubber, polyurethane, TPR, PVC, EVA or other material well known to those of ordinary skill in the art of footwear.

It is to be understood that the length, width and vertical thickness of any particular one (or pair) of the outsole 1 may vary as is customary, depending upon the application and size of footwear for which that outsole 1 is intended. An example of outsole 1 may include a body member 13 having a thickness of approximately eight millimeters, a stabilizing member 77 having a thickness of approximately four millimeters, and a tread member 75 having a thickness of approximately six millimeters.

The arcuate structure of the ribs 37 of the body member 13 provides the outsole 1 with the desired ability to permit a user's foot to be secure and stable as necessary while promoting appropriate flexing and movement of the metatarsophalangeal joints throughout the supported phases of gait, even in platform footwear that would not otherwise provide such security, stability, and flexure. In addition, the outsole 1 comprises a structure configured to attenuate impact forces applied to the user's foot and other skeletal structures during standing, walking and running.

In an application of the present invention wherein the outsole 1 is appropriately fitted to a footwear upper and worn on a user's foot, some of the primary benefits provided thereby while walking and running begin at heel strike, when the heel of the user's footwear first hits the underlying supporting surface. After each such initial impact, the user's foot pivots distally about his heel, with the lateral sides of his arch and forefoot impacting against the underlying supporting surface and his foot pronating to a neutral position with the central vertical plane of his heel generally appropriately oriented perpendicularly to the underlying supporting surface. Resiliency of the herein-described components of the outsole 1 provides cushioning for the shocks arising from such secondary impacts.

The resiliency of the body member 13 beneath the user's metatarsal heads M1–M5 also serves to attenuate and/or redistribute weight-generated forces applied there against during mid-stance through propulsive phases of his gait cycle. The described motion places the user's foot in an appropriate biomechanical position for the propulsive phase of his gait cycle during midstance and toe-off phases.

As the user's foot rotates forwardly into the toe-off phase, the body member 13 promotes appropriate natural arcuate flexure of the metatarsophalangeal joints while providing necessary support for the wearer's foot to remain stable as the user's heel lifts from the underlying supporting surface, and continuing to remain stable and appropriately flex up to the position in the user's gait whereat the metatarsophalangeal joints lift from the underlying supporting surface.

One of the primary reasons the user's foot remains stable throughout the supported phases of his gait is because the structure of the outsole 1 provides support and stability from before the user's foot rotates forwardly, whereat his heel lifts from the underlying supporting surface, to the point in the user's gait whereat the user's first metatarsal actually lifts from the underlying supporting surface. Thus, the outsole I appropriately allows the user's foot to function within the confines of his shoe.

It should be obvious from the foregoing that the material properties of the various regions of the outsole 1 appropriately flex, cushion, support and stabilize various parts of the user's foot as herein described. It should also now be obvious that the resiliencies hereinbefore described may be altered, depending upon the intended use of the footwear for which the arcuate matrix platform outsole 1 is intended. Further, it will be appreciated that the present invention is not limited necessarily to any particular type of footwear and may be equally desirable for use in shoes and boots, particularly those having thick- or platform-type soles.

It is to be understood that the invention described herein is equally applicable to outsoles for footwear for infants, toddlers, and youth as well as adults and that, while certain forms of the present invention have been illustrated and described herein, it is not to be limited to the specific forms or arrangement of parts as described and shown.

What is claimed and desired to be secured by Letters Patent is as follows:

1. An outsole for footwear, comprising a body member having a medial side, a lateral side, a toe end, a heel end, and an inner-structure that includes an arcuately shaped transverse member comprising at least two arcuately shaped ribs extending substantially from said medial side to said lateral side, the at least two ribs being longitudinally spaced apart to define a spacing, at least one arcuately shaped rib of said at least two arcuately shaped ribs having at least one sidebar extending substantially perpendicularly from said at least one arcuately shaped rib into said spacing and terminating in a free end, wherein said arcuately shaped transverse member is configured to accommodate, and be spaced approximately below, metatarsophalangeal joints of a wearer's foot inserted in footwear constructed with said body member.

2. An outsole as provided in claim 1, wherein each rib of said at least two arcuately shaped ribs has a substantially uniform fore-to-aft width.

3. An outsole as provided in claim 2, wherein said fore-to-aft width of said arcuately shaped rib is approximately three millimeters.

4. An outsole as provided in claim 2, wherein said at least one arcuately shaped rib of said at least two arcuately shaped ribs further includes at least two sidebars and wherein at least one of said at least two sidebars extends forwardly from said arcuately shaped rib and another of said at least two sidebars extends rearwardly from said arcuately rib.

5. An outsole as provided in claim 4, wherein said at least two sidebars extending forwardly from said arcuately shaped rib are laterally offset from respective said at least two sidebars extending rearwardly from said arcuately shaped rib.

6. An outsole as provided in claim 4, wherein said at least two sidebars extending forwardly from said arcuately shaped rib are aligned with respective said at least two sidebars extending rearwardly from said arcuately shaped rib.

7. An outsole as provided in claim 4, wherein said at least two sidebars adjacently spaced along said arcuately shaped rib are spaced apart approximately eight millimeters.

8. An outsole as provided in claim 1, wherein said at least one sidebar extends outwardly from each of said at least two arcuately shaped ribs and terminates at a position approximately one-half of the spacing between longitudinally spaced ones of said at least two arcuately shaped ribs.

9. An outsole as provided in claim 1, wherein said at least one arcuately shaped transverse member further includes at least two sidebars wherein at least one of said at least two sidebars extends rearwardly from a first one of said at least two arcuately shaped ribs and another of said at least two sidebars extends rearwardly from a second one of said at least two arcuately shaped ribs.

10. An outsole as provided in claim 9, wherein said at least two sidebars are laterally offset from each other.

11. An outsole as provided in claim 9, wherein a first plane, perpendicular to said body member and defined by distal ends of adjacently spaced ones of said at least two sidebars extending forwardly from one of said at least two arcuately shaped ribs that substantially underlies the wearer's metatarsophalangeal joints, intersects a second plane, also perpendicular to said body member and defined by a line through a foremost substantially symmetrical center of said toe end of said body member and through a rearmost substantially symmetrical center of said heel end of said body member, at an obtuse angle.

12. An outsole as provided in claim 11, wherein said obtuse angle is approximately one hundred degrees.

13. An outsole as provided in claim 1, wherein said at least two arcuately shaped ribs are spaced relative to said body member such that at least one of said at least two arcuately shaped ribs is spaced forwardly from the metatarsophalangeal joints of the wearer and at least one of said at least two arcuately shaped ribs is spaced rearwardly from the metatarsophalangeal joints of the wearer.

14. An outsole as provided in claim 1, further including a peripheral member along the perimeter of said body member.

15. An outsole as provided in claim 14, wherein said at least two arcuately shaped ribs are spaced relative to said body member such that at least one of said at least two arcuately shaped ribs is spaced forwardly from the metatarsophalangeal joints of the wearer and at least one of said at least two arcuately shaped ribs is spaced rearwardly from the metatarsophalangeal joints of the wearer.

16. An outsole as provided in claim 15, further including toe support structure connected to said peripheral portion and configured to reduce flexure in a space defined by a foremost one of said at least two arcuately shaped ribs and said peripheral portion.

17. An outsole as provided in claim 16, wherein at least a portion of said toe support structure includes a diagonal criss-cross structure.

18. An outsole as provided in claim 15, further including heel support structure connected to said peripheral portion and configured to reduce flexure in a space defined by a rearmost one of said at least two arcuately shaped ribs and said peripheral portion.

19. An outsole as provided in claim 18, wherein at least a portion of said heel support structure includes a diagonal criss-cross structure.

20. An outsole as provided in claim 1, wherein said body member is integrally formed.

21. An outsole as provided in claim 1, further including a tread member and a stabilizing member imposed between, and connected to each of, said body member and said tread member.

22. An outsole as provided in claim 21, wherein said body member has a thickness approximately twice the thickness of said stabilizing member.

23. An outsole as provided in claim 21, wherein said tread member has a thickness approximately one and one-half times the thickness of said stabilizing member.

24. An outsole as provided in claim 21, wherein said body member, said stabilizing member, and said tread member are integrally formed.

25. An outsole for footwear, comprising:

(a) a body member having a medial side, a lateral side, a toe end, and a heel end; said body member including:

(1) a plurality of arcuately shaped ribs having a substantially uniform fore-to-aft width and extending substantially from said medial side to said lateral side; said plurality of arcuately shaped ribs uniformly spaced apart; at least one of said arcuately shaped ribs spaced forwardly from, at least one of said arcuately shaped ribs spaced rearwardly from, and intermediate ones of said arcuately shaped ribs spaced generally below metatarsophalangeal joints of a wearer's foot inserted in footwear constructed with said body member, (2) a plurality of sidebars extending forwardly and rearwardly from each of said plurality of arcuately shaped ribs approximately one-half of the spacing between adjacently spaced ones of said plurality of arcuately shaped ribs, said plurality of sidebars extending toward each other from adjacently spaced ones of the plurality of arcuately shaped ribs being laterally offset from each other, (3) a peripheral member spaced along the perimeter of said body member and connected to each of said plurality of arcuately shaped ribs, (4) toe support structure connected to said peripheral portion and configured to reduce flexure in a space defined by a foremost one of said plurality of arcuately shaped ribs and said peripheral portion wherein at least a portion of said toe support structure includes a diagonal criss-cross structure, and (5) heel support structure connected to said peripheral portion and configured to reduce flexure in a space defined by a rearmost one of said plurality of arcuately shaped ribs and said peripheral portion wherein at least a portion of said heel support structure includes a diagonal criss-cross structure;

(b) a tread member; and (c) a stabilizing member imposed between, and connected to each of, said body member and said tread member; and (d) wherein said body member, said stabilizing member, and said tread member are integrally formed.

* * * * *